United States Patent [19]

Gonzalez et al.

[11] Patent Number: 5,027,708

[45] Date of Patent: Jul. 2, 1991

[54] SAFE ARM SYSTEM FOR A PERFORATING APPARATUS HAVING A TRANSPORT MODE AN ELECTRIC CONTACT MODE AND AN ARMED MODE

[75] Inventors: Manuel T. Gonzalez, Sugarland; Clifford L. Aseltine, Houston; Terrell E. Dailey, Bellaire, all of Tex.

[73] Assignee: Schlumberger Technology Corporation, Houston, Tex.

[21] Appl. No.: 481,133

[22] Filed: Feb. 16, 1990

[51] Int. Cl.[5] ..... F42C 15/188; F42C 15/34

[52] U.S. Cl. ..... 102/254; 89/1.15; 102/202.1; 102/262

[58] Field of Search ..... 89/1.15; 102/202.1, 102/222, 221, 254, 262; 175/4.56; 166/55

[56] References Cited

U.S. PATENT DOCUMENTS

| | | | |
|---|---|---|---|
| H, 453 | 4/1988 | Schmidlin | 102/254 |
| 3,773,119 | 11/1973 | Shore | 175/4.6 |
| 4,007,796 | 2/1977 | Boop | 175/4.56 |
| 4,011,815 | 3/1977 | Garcia | 175/4.6 |
| 4,046,076 | 9/1977 | Hampton | 102/262 |
| 4,100,978 | 7/1978 | Boop | 166/55 |
| 4,172,421 | 10/1979 | Regalbuto | 102/222 |
| 4,240,351 | 12/1980 | San Miguel | 102/254 |
| 4,292,895 | 10/1981 | Bell et al. | 102/254 |
| 4,314,614 | 2/1982 | McPhee et al. | 175/4.6 |
| 4,319,526 | 3/1982 | DerMott | 102/202.1 |
| 4,523,650 | 6/1985 | Sehnert et al. | 175/4.56 |
| 4,561,356 | 12/1985 | Bordon | 89/1.15 |
| 4,592,281 | 6/1986 | Nagennast | 102/202.1 |

*Primary Examiner*—David H. Brown

*Attorney, Agent, or Firm*—Henry N. Garrana; John H. Bouchard

[57] ABSTRACT

A safe-arm or quick arm system for a perforating gun includes a body containing a detonator and an adapter head containing an electrical plug and a detonating cord shell, the body and associated detonator being rotatable relative to the adapter head and associated detonating cord shell. Upon rotation of the body relative to the adapter head, the detonator moves from a start position to a transport position. In this position, the plug is not electrically connected to the detonator and the leads connected to the detonator are short circuited. The detonator is not adapted to receive electrical power. Upon further rotation of the body relative to the adapter head, the detonator moves from the transport position to an electrical contact position. In this position, the plug is electrically connected to the detonator but the detonator is not aligned with the detonating cord shell. Upon further rotation of the body relative to the adapter head, the detonator moves from the electrical contact position to the armed position. In this position, the plug is electrically connected to the detonator and the detonator is aligned with the detonating cord shell.

19 Claims, 2 Drawing Sheets

FIG. 1
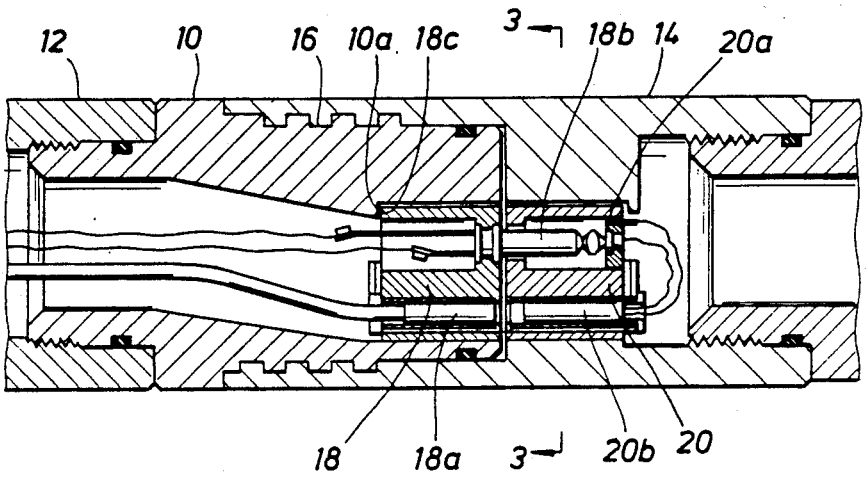
FIG. 2
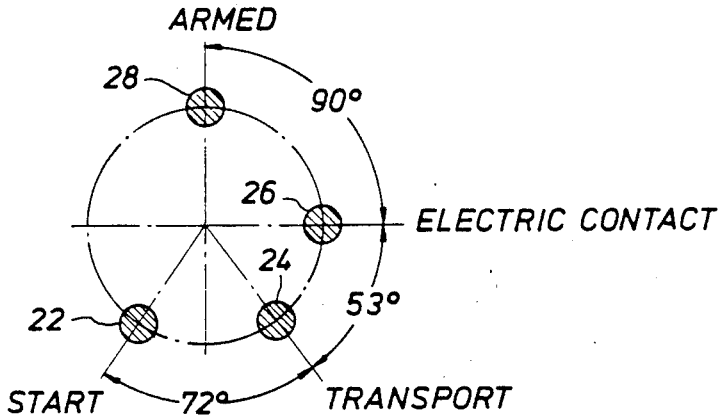
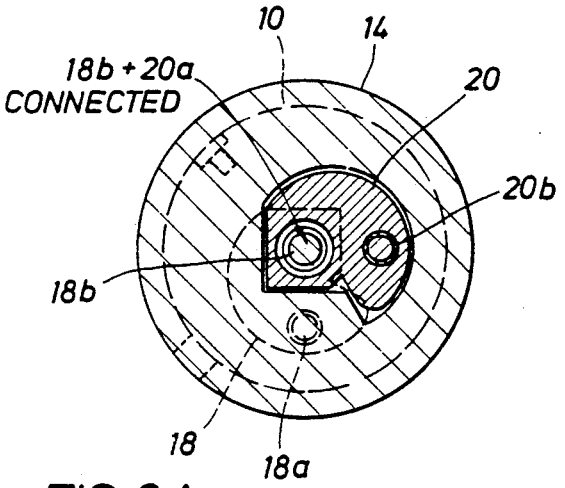
FIG. 3A
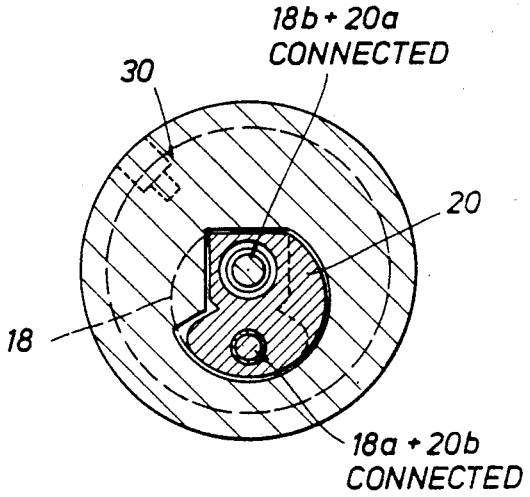
FIG. 3B

SAFE ARM SYSTEM FOR A PERFORATING APPARATUS HAVING A TRANSPORT MODE AN ELECTRIC CONTACT MODE AND AN ARMED MODE

BACKGROUND OF THE INVENTION

The subject matter of the present invention relates to a safe arm system for a perforating apparatus, the safe arm system having three modes of operation, a transport mode, an electric contact mode, and an armed mode of operation.

Various types of safe-arm, otherwise known as quick arm, systems have been devised for use in association with perforating guns. One such safe-arm system is disclosed in U.S. Pat. No. 4,172,421 to Regalbuto. This safe-arm system involves rotatably aligning a detonator into and out of alignment with a booster. When the detonator is rotated into alignment with the booster, the system is armed, whereas when the detonator is rotated out of alignment with the booster, the system is not armed. This system contains one method for preventing an accidental detonation of the associated perforating gun. However, there is only one method used in this system for preventing accidental detonation. An improved safe-arm system would contain more than one method for preventing the accidental detonation of the perforating gun, especially during transport of the perforating gun.

SUMMARY OF THE INVENTION

Accordingly, it is a primary object of the present invention to provide a perforating apparatus which includes a safe-arm and quick arm system, the safe-arm system functioning to provide two methods or modes for preventing accidental detonation of the perforating apparatus, that is, a first electrical connection method that electrically connects a detonator to a source of power before a ballistic connection is made, and a second ballistic connection or alignment method that ballistically connects or aligns the detonator with the booster following the electrical connection.

It is a further object of the present invention to provide a safe-arm system for use in connection with a perforating apparatus wherein the perforating apparatus is transported when the safe-arm system is placed in a transport mode, the transport mode being used when the electrical connection of the detonator to the source of power and the ballistic connection or alignment of the detonator to the booster is not desired, the detonator being disconnected from the source of power, the leads connected to the detonator being short circuited, and the detonator being out of alignment relative to the booster when the safe-arm system is placed in the transport mode.

It is a further object of the present invention to provide a safe-arm system for use in a perforating apparatus which initially provides for a transport mode wherein a detonator is not electrically connected to a source of power and is not aligned relative to a detonating cord shell or booster, secondly provides an electrical contact mode wherein the detonator is electrically connected to a source of power in response to rotation of an adapter head relative to a body but is still not aligned relative to a detonating cord shell or booster, and thirdly provides an armed mode wherein the detonator is both electrically connected to a source of power and aligned relative to a detonating cord shell or booster in response to further rotation of the adapter head relative to the body.

It is a further object of the present invention to provide a safe arm system for use with a perforating gun which comprises a plurality of parts, easily fit together during assembly.

It is a further object of the present invention to provide a safe arm system for use with a perforating gun which comprises four parts, a head, a body, a detonating cord module and a detonator retainer module, the detonating cord module being easily fit within the head, the detonator retainer module being easily fit within the body, the head and the body being threadedly connected together.

In accordance with these and other objects of the present invention, a perforating apparatus is transported from one location to another when a quick arm adapter head of the safe-arm system of the present invention is placed in a transport position relative to a quick arm body; when in the transport position, a detonator is not electrically connected to a source of power, the leads connected to the detonator are short circuited, and the detonator is out of alignment with respect to a booster connected to the detonating cord. When the quick arm adapter head is rotated with respect to the quick arm body from the transport position to an electrical contact position, a plug is connected electrically to a jack and, as a result, the detonator is connected to a source of power. However, without further rotation of the adapter head with respect to the adapter body, the detonator is out of alignment with respect to a booster or detonating cord shell. Now that electrical connection has been made, connecting the detonator to the source of power, further rotation of the quick arm adapter head with respect to the quick arm body from the electrical contact position to an armed position aligns the detonator with the booster. Therefore, when the safe-arm system is not in the transport mode, two levels of safety with respect to the handling of the perforating apparatus is presented: a first level providing for the necessary electrical connection before a ballistic connection is made, and a second level providing for the necessary ballistic connection after the electrical connection has been made. In addition, the safe arm system of the present invention is easily assembled; it comprises four parts which easily interfit together, that is, a head, a body, a detonating cord module and a detonator retainer module. The detonating cord module easily fits within the head and the detonator retainer module easily fits within the body, the head and the body being threadedly connected together.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will b obtained from the detailed description of the preferred embodiment presented hereinbelow, and the accompanying drawings, which are given by way of illustration only and are not intended to be limitative of the present invention, and wherein:

FIG. 1 illustrates a safe-arm system for use in a perforating apparatus in accordance with the present invention;

FIG. 2 illustrates a plurality of positions or modes associated with the safe-arm system of FIG. 1;

FIGS. 3A and 3B illustrate the safe-arm system of FIG. 1 taken long section lines 3—3 of FIG. 1.

DETAILED DESCRIPTION OF THE PREFERRED EMBODIMENT

Figure 4A:
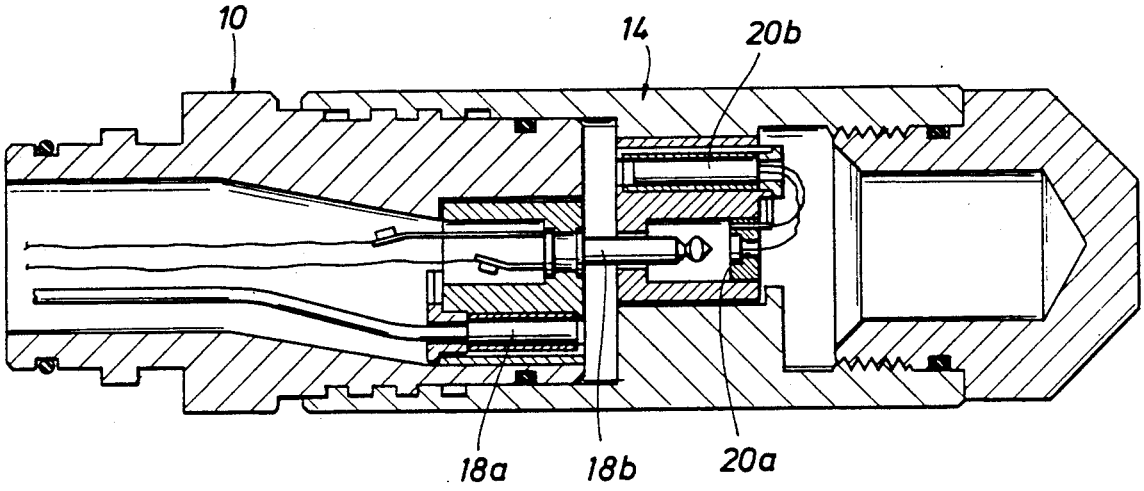
FIGS. 4A and 4B illustrate the safe-arm system of FIG. 1 when the system is ballistically misaligned, FIG. 4A, and when the system is ballistically aligned, FIG. 4B.

Referring to FIG. 1, the safe-arm system of the present invention, otherwise termed a quick arm system, is illustrated.

In FIG. 1, the safe-arm system includes an adapter head 10 threadedly connected to a lower gun head 12 on one side and threadedly connected to a body 14 on the other side. More specifically, a modified helical threaded connection 16 exists between the adapter head 10 and the body 14; when the adapter head 10 is rotated clockwise, it approaches the body 14; when the adapter head 10 is rotated counterclockwise, it withdraws from the body 14. The modified helical threaded connection 16 is discussed in more detail below. A detonating cord module 18 is disposed within the adapter head 10, the detonating cord module 18 including a detonating cord shell 18*a* and an electrical plug 18*b*, the detonating cord shell 18*a* including a booster and a detonating cord disposed adjacent the booster in the shell 18*a* and adapted for connection to a perforating apparatus. The booster is detonated by a separate detonator 20*b* described below and initiates transmission of a detonating wave along the detonating cord for detonation of plurality of explosive charges in the perforating apparatus. The plug is adapted for plugging into an electrical jack, to be described below. A portion 18*c* of the detonating cord module 18 contacts a ledge 10*a* of the adapter head 10; when the adapter head 10 is rotated clockwise relative to the body 14, due to the existance of modified helical threads 16 between head 10 and body 14, the adapter head 10 and the detonating cord module 18, including the plug 18*b*, approaches the body 14, since the ledge 10*a* of adapter head 10 contacts and forces the portion 18*c* of the module 18 to approach the body 14. The modified helical threads 16 will be discussed in more detail below. A detonator retainer module 20 is disposed within and physically connected to the body 14, the detonator retainer module being disposed adjacent the detonating cord module 18, the detonator retainer module 20 including a detonator 20*b* and an electrical jack 20*a* into which the electrical plug 18*b* "plugs" or is inserted when the adapter head 10 is rotated clockwise relative to the body 14. As a result of the physical connection between module 20 and the body 14, a rotation of the body 14 will correspondingly rotate the detonator retainer module 20. The electrical jack 20*a* is electrically connected to the detonator 20*b*. Since the body 14 is rotatably relative to the adapter head 10, the detonator retainer module 20 is also rotatable relative to the adapter head 10; therefore, when the module 20 rotates, detonator 20*b* rotates into and out of alignment with the detonating cord module 18 and the detonating cord shell 18*a*. As will be noted below, rotation of the body 14 relative to the head 10 from a "start" position or mode will cause the safe-arm system of FIG. 1 to pass through three positions or operate sequentially in three modes, that is, a transport position or mode, an electrical contact position or mode, and an armed position or mode. The term "modified helical threads 16" is intended to include the threads, if any, which exist between the start position and the armed position. The specific construction of each of the threads 16 which exist between (1) the start position and the transport position, (2) the transport position and the electric contact position, and (3) the electric contact position and the armed position is provided in this paragraph. Between the start position and the transport position, the threads 16 are helical; when body 14 rotates relative to head 10, head 10 advances toward body 14. Between the transport position and the electric contact position, the threads 16 are divided into a non-helical "first land" portion and a helical portion; when body 14 rotates relative to head 10, the head 10 first engages the first land portion and fails to advance toward body 14; however, head 10 subsequently engages the helical portion of the threads 16 between the transport position and the electric contact position and begins to advance toward body 14. Between the electric contact position and the armed position, the threads 16 are a non-helical "second land" portion; thus, when body 14 rotates relative to head 10, between the electric contact position and the armed position, the head 10 fails to advance toward body 14.

Referring to FIG. 2, a plurality of positions or modes associated with the safe-arm system of FIG. 1 is illustrated.

In FIG. 2, since the body 14 is rotatable relative to the adapter head 10, the detonator retainer module 20 is also rotatable relative to the detonating cord module 18; therefore, detonator 20*b* is rotatable relative to the detonating cord shell 18*a*. The detonator 20*b* is initially placed in a "start" position 22 relative to the detonating cord shell 18*a*. Rotation of the detonator 20*b* relative to the detonating cord shell 18*a* from the "start" position 22 will cause the safe-arm system of FIG. 1 to pass through three other positions or operate sequentially in three other modes, that is, a transport position or mode 24, an electrical contact position or mode 26, and an armed position or mode 28.

When the detonator 20*b* is rotated from the start 22 position to the transport 24 position, electrical contact has not been made between the electrical jack 20*a* and the electrical plug 18*b*, and the leads connected to the detonator 20*b* are short circuited by the electrical jack 20*a*. In addition, the detonator 20*b* is out of alignment relative to the detonating cord shell 18*a*. Therefore, when a perforating gun containing the safe-arm system of FIG. 1 is transported from one location to another, accidental detonation of the gun cannot occur.

When the detonator 20*b* is rotated from the transport position 24 to the electric contact position 26, electrical contact is made between the electrical jack 20*a* and the electrical plug 18*b* and the short circuit existing between the leads connected to the detonator 20*b* is removed. As a result, detonator 20*b* is adapted to receive electrical power from a well surface via the plug 18*b* and jack 20*a* when a power switch is actuated at the well surface. However, when disposed in the electric contact position 26, the detonator 20*b* is still out of alignment relative to the detonating cord shell 18*a*. Therefore, even if power is supplied to the detonator 20b, since the detonator 20b is out of alignment relative to the shell 18a, a subsequent detonation of detonator 20b will not cause a detonation wave to transfer from the detonator 20b to a detonating cord contained in the detonating cord shell 18a.

When the detonator 20b is rotated from the electric contact position 26 to the armed position 28, the electrical plug 18b still makes electrical contact with the electrical jack 20a and and the detonator 20b is aligned with the detonating cord shell 18a. Detonator 20b is adapted to receive power from the well surface (when an operator at the well surface actuates a switch initiating the transfer of electrical power from a power source to the detonator 20b via the plug 18b and the jack 20a) and, since the detonating cord shell 18a is aligned with the detonator 20b, the detonating cord contained within the detonating cord shell 18a is adapted to receive a detonation wave from the detonator 20b when the detonator 20b detonates in response to receipt of the electrical power from the well surface.

Referring to FIGS. 3A and 3B, the safe-arm system of FIG. 1, taken along section lines 3—3 of FIG. 1, is illustrated.

FIG. 3A illustrates the detonator retainer module in the electric contact position 26, that is, the electrical plug 18b is electrically connected to the electrical jack 20a, but the detonator 20b is out of alignment with the detonating cord shell 18a.

FIG. 3B illustrates the detonator retainer module in the armed position 28, that is, the electrical plug 18b is electrically connected to the electrical jack 20a, and the detonator 20b is aligned with the detonating cord shell 18a. A screw 30 locks the body 14 in the armed position 28.

Figure 4B:
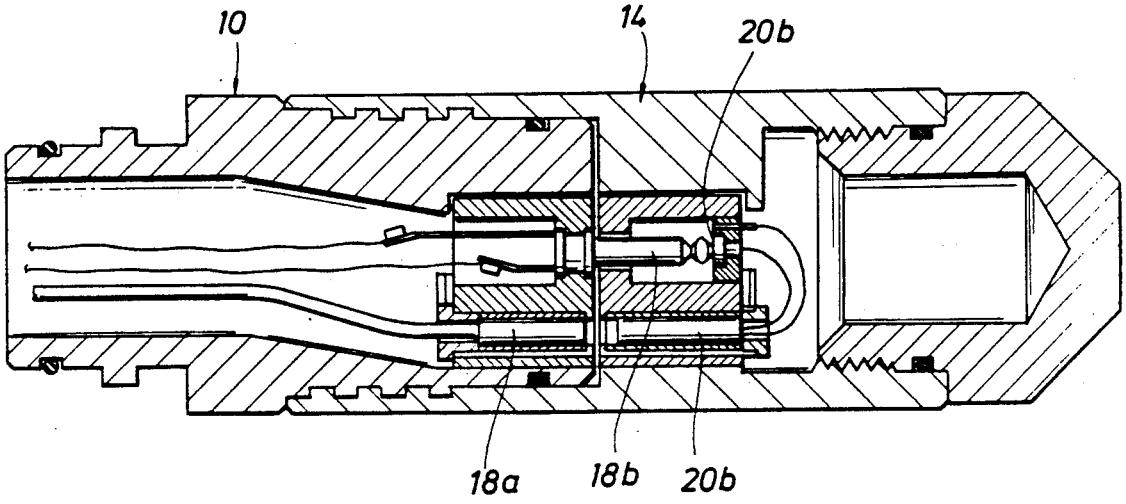

Referring to FIGS. 4A and 4B, side views of the safe-arm system of FIG. 1 are illustrated, FIG. 4B being identical to the safe-arm system shown in FIG. 1 and illustrating the detonator 20b as being aligned with the detonating cord shell 18a, FIG. 4A illustrating the detonator 20b out of alignment relative to detonating cord shell 18a.

Since the adapter head 10 is rotatable relative to the body 14, a rotation of body 14 will also rotate the detonator retainer module 20 which contains the detonator 20b.

In FIG. 4A, the detonator 20b is shown disposed opposite to and therefore out of alignment with the detonating cord shell 18a. In this position, the detonator 20b is disposed half-way between the start position 22 and the transport position 24 of FIG. 2. An electrical connection is not made between the plug 18b and the jack 20a and the detonator 20b is out of alignment relative to detonating cord shell 18a.

In FIG. 4B, the detonator 20b is shown aligned with the detonating cord shell 18a. In this position, the detonator 20b is disposed in the armed position 28 of FIG. 2. In addition, an electrical connection is made between the plug 18b and the jack 20a.

In operation, referring to FIGS. 1-4B, when the body 14 is rotated relative to the adapter head 10, since the detonator retainer module 20 is physically connected to the body 14, the detonator retainer module 20 rotates with the body 14. Since the detonator 20b is disposed within the module 20, rotation of module 20 rotates detonator 20b. The detonator 20b is initially disposed in the start position 22.

Upon rotation of body 14 and module 20 relative to head 10, detonator 20b moves from the start position 22 to the transport position 24. When left in this position, the detonator 20b is not adapted to electrically receive a source of electrical power, since the plug 18b is not electrically connected in jack 20a and the detonator 20b is out of alignment relative to the detonating cord shell 18a. A perforating gun, containing the safe-arm system in this configuration (the detonator 20b is in the transport position), may be safely moved from one location to another without fear of accidental detonation.

Upon further rotation of body 14 and module 20 relative to head 10, detonator 20b moves from the transport position 24 to the electric contact position 26. In this position, the detonator 20b is adapted to electrically receive the source of power since the plug 18b is now electrically connected in jack 20a; however, the detonator 20b is still out of alignment relative to the detonating cord shell 18a. Therefore, even if the detonator 20b does detonate, a detonation wave cannot transfer to the detonating cord within the detonating cord shell 18a.

Upon further rotation of body 14 and module 20 relative to head 10, detonator 20b moves from the electric contact position 26 to the armed position 28. In this position, the detonator 20b is still adapted to electrically receive the source of power since the plug 18b is still electrically connected in jack 20a; however, in addition, the detonator 20b is now aligned relative to the detonating cord shell 18a. Therefore, if the detonator 20b detonates, a detonation wave transfers to the detonating cord within the detonating cord shell 18a.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A safe arm system adapted for use in association with a perforating apparatus, comprising:

a housing including a body and a head threadedly connected to said body, said body being rotatable relative to said head when said head threadedly connects to said body;

a first module disposed within said body including an electrical jack and a detonator electrically connected to said jack;

a second module disposed within said head including a booster, a detonating cord disposed adjacent said booster and adapted for connection to said perforating apparatus, and an electrical plug adapted for connection to a power source and adapted for insertion into said electrical jack when said body rotates relative to said head;

said detonator being rotatable between a transport position, an electric contact position, and an armed position when said body rotates relative to said head.

2. The safe arm system of claim 1, wherein the threaded connection between said head and said body comprises a first helical portion, and wherein said electrical plug is connected to said power source and is inserted into said electrical jack but is electrically disconnected from said detonator and said detonator is ballistically misaligned relative to said booster when said first module including said detonator is rotated to said transport position via said first helical portion of said threaded connection between said body and said head.

3. The safe arm system of claim 2, wherein the threaded connection between said head and said body further comprises a land portion disposed adjacent said first helical portion and as second helical portion disposed adjacent said land portion, and wherein said electrical plug is connected to said power source, is inserted into said electrical jack, and is electrically connected to said detonator but said detonator is ballistically misaligned relative to said booster when said first module including said detonator is rotated to said electric contact position via said land portion and said second helical portion of said threaded connection between said body and said head.

4. The safe arm system of claim 3, wherein the threaded connection between said head and said body further comprises a further land portion disposed adjacent said second helical portion, and wherein said electrical plug is connected to said power source, is inserted into said electrical jack and is electrically connected to said detonator and said detonator is aligned relative to said booster when said first module including said detonator is rotated to said armed position via said further land portion of said threaded connection between said body and said head.

5. A method of using a safe arm apparatus to arm a perforating apparatus, comprising the steps of:

(a) rotating a body relative to a head of said safe arm apparatus from a transport position to an electric contact position; and (b) further rotating said body relative to said head from said electric contact position to an armed position, whereby said perforating apparatus is armed only when said body relative to said head is in the armed position.

6. The method of claim 5, wherein said safe arm apparatus includes a power source, a detonator, a connection means disposed between said power source and said detonator for connecting said power source to said detonator in response to rotation of said body relative to said head, and a booster with an attached detonating cord, wherein the rotating step (a) comprises the further steps of:

rotating said body relative to said head from said transport position, where said connection means fails to electrically connect said power source to said detonator and said detonator is ballistically misaligned relative to said booster, to said electric contact position, where said connection means electrically connects said power source to said detonator but said detonator is still ballistically misaligned relative to said booster.

7. The method of claim 6, wherein the further rotating step (b) comprises the further step of:

rotating said body relative to said head from said electric contact position to said armed position, where said connection means electrically connects said power source to said detonator and said detonator is ballistically aligned relative to said booster.

8. A safe arm apparatus adapted for use in a perforating apparatus, comprising:

a head including a booster adapted to be connected to a detonating cord of said perforating apparatus and an electrical plug; and a body threadedly connected to said head and rotatable sequentially between a plurality of rotation positions with respect to said head, said rotation positions including a transport rotation position, an electric contact rotation position, and an armed rotation position, said body including, electrical jack means for receiving said electrical plug from said head and electrically connecting said plug to said jack means when said body is rotated from said transport rotation position to said electric contact rotation position with respect to said head, and detonator means electrically connected to said jack means and rotatable with respect to said booster in response to a corresponding rotation of said body with respect to said head for detonating and igniting said booster when siad plug is electrically connected to said jack means and said body including said detonator means is rotated from said electric contact rotation position to said armed rotation position.

9. The safe arm apparatus of claim 8, wherein said detonator means is rotatable from a ballistic misalignment position to another ballistic misalignment position with respect to said booster when said body is rotated from said transport rotation position to said electric contact rotation position, said detonator means being rotatable from said another ballistic misalignment position to a ballistic alignment position with respect to said booster when said body is further rotated from said electric contact rotation position to said armed rotation position.

10. The safe arm apparatus of claim 9, wherein said electrical jack means electrically connects said plug to said detonator means when said body is rotated from said transport rotation position to said electric contact rotation position and maintains the electrical connection of said plug to said detonator means when said body is further rotated from said electric contact rotation position to said armed rotation position.

11. The safe arm apparatus of claim 10, wherein the threaded connection of said body with respect to said head includes a first land portion and a subsequent first helical portion disposed between the transport rotation position and the electric contact rotation position of said body relative to said head.

12. The safe arm apparatus of claim 11, wherein said threaded connection of said body with respect to said head further includes a non-helical further land portion disposed between the electric contact rotation position and the armed rotation position of said body relative to said head.

13. A method of arming a detonating apparatus, comprising the steps of:

(a) electrically connecting power switch to a detonator of said detonating apparatus while simultaneously maintaining said detonator in ballistic misalignment relative to a booster of said detonating apparatus; and (b) while maintaining the electrical connection between said power switch and said detonator, subsequently ballistically aligning said detonator relative to said booster of said detonating apparatus.

14. The method of claim 13, wherein said detonating apparatus includes a head and a body threadedly connected to and rotatable with respect to said head, and wherein the connecting step (a) comprises the step of:

rotating said body relative to said head from a first position to a second position thereby electrically connecting said power switch to said detonator of said detonating apparatus, the detonator being ballistically misaligned relative to said booster when the body relative to the head is disposed in said second position.

15. The method of claim 14, wherein the aligning step (b) comprises the step of:

rotating said body relative to said head from said second position to a third position, the power switch being electrically connected to said detonator and said detonator being ballistically aligned relative to said booster when the body relative to the head is disposed in said third position.

16. Apparatus for arming a detonating apparatus, said detonating apparatus including a detonator and a booster, comprising:

electrical connection means for electrically connecting a power source to said detonator of said detonating apparatus; and alignment means responsive to the electrical connection made by said electrical connection means for subsequently aligning said detonator with said booster of said detonating apparatus after said electrical connection means electrically connects said power source to said detonator.

17. The apparatus of claim 16, wherein said electrical connection means comprises:

an electrical plug connected to said power source; and electrical jack means for receiving said plug in said jack means and electrically connecting said power source to said detonator when said plug is fully received in said electrical jack means.

18. The apparatus of claim 17, wherein said alignment means comprises:

rotating means for rotating said detonator into ballistic alignment with said booster of said detonating apparatus but only after said plug is fully received in said jack means and the electrical connection is made between said power source and said detonator.

19. The apparatus of claim 18, wherein said rotating means comprises:

a head including said plug and said booster of said detonating apparatus; and a body threadedly connected to said head, said body including said jack means for receiving said plug and said detonator of said detonating apparatus, said body being rotatable with respect to said head when said plug is fully received in said jack means, said detonator being rotatable into ballistic alignment with said booster w hen said plug is fully received in said jack means and said body is rotated with respect to said head.

* * * * *